United States Patent [19]

Beetschen et al.

[11] 4,170,682

[45] Oct. 9, 1979

[54] TREATMENT OF NYLON FABRIC FOR WETTABILITY AND PRODUCT THEREOF

[75] Inventors: Robert E. Beetschen; Basil P. Lynch, both of Spencer; Allie A. Short, Reedy, all of W. Va.

[73] Assignee: Kellwood Company, St. Louis, Mo.

[21] Appl. No.: 797,995

[22] Filed: May 18, 1977

[51] Int. Cl.[2] ..... D06M 15/12

[52] U.S. Cl. ..... 428/267; 8/115.6; 8/159; 252/8.8; 252/357; 427/242; 427/390 R; 427/390 B; 427/430 R; 428/279; 428/290; 428/395; 428/411; 428/475.5

[58] Field of Search ..... 428/474, 395, 279, 260, 428/267, 265, 290, 411; 427/390 B, 390 R, 430 R, 434 C, 242, 394; 252/357, 352, 8.8 R, 8.8 A, 8.8 AJ, 8.8 B, 8.8 Q; 8/DIG. 21, 159, 115.6

[56] References Cited

U.S. PATENT DOCUMENTS

| | | | |
|---|---|---|---|
| 3,420,703 | 1/1969 | Kirschnek et al. | 427/430 |
| 3,956,143 | 5/1976 | Cuntze et al. | 428/279 |
| 3,968,315 | 7/1976 | Hochreuter | 428/474 |

OTHER PUBLICATIONS

Fornelli, "Experimental Application of a Turbodynamic Principle in Dyeing," American Dyestuff Reporter, Jul. 4, 1955, p. 456.

*Primary Examiner*—Michael W. Ball
*Attorney, Agent, or Firm*—Koenig, Senniger, Powers and Leavitt

[57] ABSTRACT

The treatment of nylon fabric for wettability, with the treated fabric capable of withstanding a substantial number of launderings without undue loss of wettability, involving exhaustion of a condensation product of ethylene oxide with an aliphatic primary amine having between about 16 and about 18 carbon atoms in a ratio of about 16 moles ethylene oxide per mole of said primary amine, quaternized with methyl sulfate, onto the fabric under relatively intense agitation.

15 Claims, No Drawings

TREATMENT OF NYLON FABRIC FOR WETTABILITY AND PRODUCT THEREOF

BACKGROUND OF THE INVENTION

This invention relates to the treatment of nylon fabrics for wettability, and more particularly to a method of treating nylon fabrics, and especially knit nylon garments, to improve their moisture absorption characteristics, and to nylon fabrics so treated.

Nylon fabrics generally have poor wettability (moisture absorbency) and are therefore not as comfortable to wear as textile fabrics made of natural material such as cotton, which fabrics have good wettability and therefore readily transfer perspiration away from the skin. Modes of treating nylon fabrics to improve their wettability have been sought, but we are unaware of any which has provided not only the desired improvement in wettability but also the ability to retain this improvement over a large number of washings of the material, and which also has acceptable "hand".

SUMMARY OF THE INVENTION

Among the several objects of the invention may be noted the provision of a method of treating nylon fabric to improve its wettability; the provision of such a method for imparting to the nylon fabric a wettability comparable to that of cotton fabric, so that the fabric is comfortable to wear; the provision of such a method adapted to impart a wash-resistant wettability to the fabric such that the fabric may be laundered a relatively large number of times (e.g., thirty-five home launderings) without undue loss of wettability; the provision of such a method which does not adversely affect the "hand" of the fabric; the provision of such a method which is relatively economical to carry out considering the results; and the provision of nylon fabric so treated for wettability.

In general, the invention involves the treatment of the nylon fabric by agitating it in a bath comprising a wettability treatment agent in water, said agent comprising a condensation product of ethylene oxide with an aliphatic primary amine having between about 16 and about 18 carbon atoms in a ratio of about 16 moles ethylene oxide per mole of said primary amine, quaternized with methyl sulfate, the bath being at a temperature of from about 110° F. to 130° F., the agitation being such as to cause relative flow of the bath through the fabric from opposite sides of the fabric, the amount of said agent in the bath and the agitation being such as to cause exhaustion of said agent in amount from at least about 0.35% to about 1.40% by weight of the fabric onto the fabric from the bath with said agent dispersed substantially uniformly throughout the fabric. The resultant fabric is wettable to the extent that a one inch by six inch specimen will wick at least about three inches of water in three minutes, a ten inch by two inch specimen will saturate in less than four minutes, a ten inch by two inch specimen will transfer one hundred cc. of water in less than thirty-five minutes, a one-half by one-half inch specimen will saturate substantially instantly when dropped in water, and a drop of water dropped onto the fabric loses its specular reflective power substantially instantly, and retains said wettability for at least about thirty-five launderings of the home laundering type.

Other objects and features will be in part apparent and in part pointed out hereinafter.

DESCRIPTION OF THE PREFERRED EMBODIMENT

This invention is based on the discovery that an agent comprising a condensation product of ethylene oxide with an aliphatic primary amine having between about 16 and about 18 carbon atoms in a ratio of about 16 moles ethylene oxide per mole of said primary amine, quaternized with methyl sulfate, heretofore used as an antistatic agent for synthetic fabrics by being applied to the fabric by means of a padder or quetsch, usually at a temperature of 100° to 120° F., or by exhausting onto the fabrics for 10 to 20 minutes at a temperature of 110° to 120° F., may be utilized to impart wash-resistant wettability properties to nylon fabric provided said agent is exhausted onto the fabric with a relatively high degree of agitation, much higher than any agitation heretofore involved in impregnating fabrics with said agent for antistatic purposes. Said agent is hereinafter referred to as the "wettability treatment agent".

In accordance with this invention, the work to be treated, which may be nylon fabric per se but more usually would consist of a batch of nylon garments such as knit nylon shirts, stockings, pantyhose, etc., is agitated in a bath comprising said agent in water, the bath being at a temperature of from about 110° F. to 130° F., the agitation being such as to cause relative flow of the bath through the fabric (fabric per se or through the fabric of garments being treated) from opposite sides of the fabric, the amount of said wettability treatment agent in the bath and the agitation being such as to cause exhaustion of said agent in amount from about 0.35% to about 1.40% by weight of the fabric onto the fabric from the bath with said agent dispersed substantially uniformly throughout the fabric.

It is preferred that the amount of said wettability treatment agent exhausted onto the fabric be about 0.70% by weight of the fabric, e.g., 0.70 lbs. of said agent per 100 lbs. of fabric.

The agitation is preferably a relatively intense agitation accomplished, according to the preferred manner, in a commercial laundering machine of the rotary perforated drum type, and more particularly a Norwood Cascade machine manufactured by the American Laundry Machine Co. This machine generally comprises a perforated horizontal drum rotatable on a horizontal axis in a horizontal cylindrical tank. The drum has a central partition dividing it into two compartments each having a 50. lb capacity. The drum has a 42" diameter, and each compartment is 32" long. The drum has three internal paddles spaced at 120° intervals around its inside circumference, each paddle extending radially inward 8" from the cylindrical drum wall. The drum is driven via means which is operable to rotate the drum through approximately five revolutions in one direction in approximately fourteen seconds, then to cause the drum to stop for approximately ten seconds, then to rotate the drum through approximately five revolutions in the opposite direction in approximately fourteen seconds, then to cause the drum to stop for approximately ten seconds, and then to repeat this cycle. This provides approximately fifteen revolutions of the drum per minute, for relatively intense agitation. The machine, when filled with water to its normal level, holds about 258 gallons.

In treating a batch of nylon fabric, e.g., a batch of knit nylon garments such as shirts or stockings, the batch is placed in the laundering machine as above described, the machine is filled to its normal level with water (258 gallons of water, which weighs about 2150 lbs.) and said wettability agent in amount from about 0.016% to about 0.065% by weight of the weight of the water, is put in for dispersion in the water. This corresponds to from about 0.35% to about 1.40% by weight of a 100 lb. batch of garments, i.e., from about 0.35 lb. to about 1.40 lb. of said wettability agent for the 100 lb. batch of garments. It has been preferred to use 0.032% by weight of the weight of the water, which is 0.70 lb. for a 100 lb. batch of garments. The machine is then operated for a sufficient length of time to cause exhaustion of said wettability treatment agent onto the fabric. This time is about twenty minutes for the above-described machine, meaning about three hundred revolutions of the drum of the machine, half in one direction and half in the other, so that the fabric is thoroughly tumbled one way and the other. The tumbling results in relative flow of the bath of said wettability treatment agent in water through the fabric from opposite sides of the fabric, repeated many times.

The following examples illustrate the invention.

EXAMPLE I

One hundred lbs. of knit nylon fabric knit from 70/2 nylon yarn and dyed a coral color was treated with 0.70 lb. of said wettability treatment agent in about 258 gallons of water at 110° F. for twenty minutes in a machine as above described. The fabric was essentially non-wettable prior to the treatment. Specimens of the treated fabric were then subjected to five separate tests before any laundering of the specimens, and after one, five, ten, fifteen, twenty, twenty-five, thirty and thirty-five launderings, to determine the wettability of the fabric. These tests were (1) the vertical wicking test; (2) the saturation test; (3) the transfer test; (4) the sink test; and (5) the drop test, to be described below. The laundering involved a simulation of home laundering practices, utilizing a typical home automatic washing machine, a typical home automatic dryer, and a typical home laundry detergent. The full water level of the washing machine was used in conjunction with the wash-and-wear colored cycle. The specimens so washed were removed immediately after the final spin cycle, and placed in the dryer and dried.

The vertical wicking test generally involves dipping a 1"×6" specimen of the treated fabric in water for wicking of the specimen, and measuring the number of inches wicked in three minutes. More particularly, this test involves placing one end of the 1"×6" test specimen in a buret holder, lowering the holder until one inch of the specimen is submerged one inch into a test beaker containing 100 cc. of ordinary tap water, allowing the specimen to wick for three minutes, removing the specimen, and measuring the number of inches wicked excluding the one inch that was submerged.

The saturation test involves submerging a 10"×2" specimen of the treated fabric two inches into a test beaker containing 100 cc. of ordinary tap water, draping the remaining portion of the length of the specimen across the test beaker so that the overhang will drain into a lavatory, and measuring the length of time from the instant the specimen is submerged to the instant when the first drop of water falls from the end of the specimen. This, in effect, measures wicking time.

The transfer test follows the same procedure as the saturation test except that measurement is made of the length of time required for the entire 100 cc. of water to be transferred out of the test beaker. One hour is used as a stopping point and measurement is made of the amount of water remaining in the beaker. Also, the wet weight of the sample is measured immediately after the transfer or at the end of one hour, whichever is first.

The sink test involves dropping a ½"×½" square test specimen of the treated fabric into a glass beaker containing 50 cc. of water. The time required for the test specimen to completely saturate with water is recorded. Generally, the specimen will sink when saturated, but may not do so because of air beads. In any event, the saturation time is what is important, whether the specimen sinks or not. The shorter the saturation time, the more wettable is the specimen; a highly wettable specimen saturates instantly in this test.

In the drop test, a drop of water is allowed to fall from a height of ⅜" above a test specimen onto the test specimen (using a conventional dropper). The time from the instant the drop starts to fall to the instant the water on the surface of the test specimen loses its specular reflective power is measured. This is repeated three times at different points on the test specimen and the average time of the three tests is taken as the wetting time for the specimen. A highly wettable specimen wets instantly in this test. If the drop of water does not saturate within 0.10 minute, it is considered zero saturation.

The results of testing the specimens of Example I are shown in Table I.

TABLE I

| Number of Launderings | Vertical Wicking Test Inches | Saturation Test Time Minutes | Transfer Test Time Minutes | Sink Test Average Time 3 Squares Minutes | Drop Test Average Time 3 Drops Minutes |
|---|---|---|---|---|---|
| 0 | 3⅝ | 2.46 | 28.41 | 0.00 | 0.00 |
| 1 | 3½ | 2.70 | 28.23 | 0.00 | 0.00 |
| 5 | 1¼ | 3.40 | 22.60 | 0.04 | 0.02 |
| 10 | 2½ | 2.39 | 21.86 | 0.00 | 0.00 |
| 15 | 3 | 2.52 | 26.30 | 0.00 | 0.00 |
| 20 | 3 | 2.96 | 32.41 | 0.00 | 0.00 |
| 25 | 3⅝ | 2.41 | 32.14 | 0.00 | 0.00 |
| 30 | 1⅝ | 3.90 | 32.48 | 0.06 | 0.10 |
| 35 | 3⅜ | 2.75 | 27.64 | 0.00 | 0.00 |

EXAMPLE II

One hundred lbs. of knit nylon fabric knit from 70/2 nylon yarn and dyed a banana color was treated with 0.70 lb. of said wettability treatment agent in about 258 gallons of water at 110° F. for twenty minutes in a machine as above described. The fabric was essentially non-wettable before treatment. Specimens of the treated fabric were subjected to the five above tests before any laundering and after one, five, ten, fifteen, twenty, twenty-five, thirty and thirty-five launderings, to determine the wettability of the fabric. The results of testing the specimens of Example II are shown in Table II.

TABLE II

| Number of Launderings | Vertical Wicking Test Inches | Saturation Test Time Minutes | Transfer Test Time Minutes | Sink Test Average Time 3 Squares Minutes | Drop Test Average Time 3 Drops Minutes |
|---|---|---|---|---|---|
| 0 | 2¼ | 2.65 | 24.30 | 0.00 | 0.00 |
| 1 | 3¼ | 2.66 | 25.50 | 0.00 | 0.00 |
| 5 | 2½ | 2.48 | 27.01 | 0.00 | 0.00 |
| 10 | 3½ | 2.45 | 27.11* | 0.00 | 0.00 |
| 15 | 3 | 2.51 | 30.50 | 0.00 | 0.00 |
| 20 | 1⅞ | 3.19 | 26.51 | 0.01 | 0.05 |
| 25 | 3¼ | 2.50 | 25.00 | 0.00 | 0.00 |
| 30 | 3⅝ | 2.36 | 26.47 | 0.00 | 0.00 |
| 35 | 2¾ | 2.00 | 24.00 | 0.00 | 0.00 |

*11 launderings

EXAMPLE III

Four lbs. of knit nylon fabric knit from 70/2 nylon yarn and dyed a navy blue color was treated with 0.70 lb. of said wettability treatment agent in about 258 gallons of water at 110° F. for twenty minutes in a machine as above described. The fabric was essentially non-wettable before treatment. Specimens of the treated fabric were subjected to the five above tests before any laundering and after one, five, ten, fifteen, twenty, twenty-five, thirty and thirty-five launderings, to determine the wettability of the fabric. The results of testing the specimens of Example III are shown in Table III.

TABLE III

| Number of Launderings | Vertical Wicking Test Inches | Saturation Test Time Minutes | Transfer Test Time Minutes | Sink Test Average Time 3 Squares Minutes | Drop Test Average Time 3 Drops Minutes |
|---|---|---|---|---|---|
| 0 | 3½ | 2.69 | 26.05 | 0.00 | 0.00 |
| 1 | 2½ | 4.81 | 49.21 | 0.00 | 0.00 |
| 5 | 2⅜ | 3.41 | 28.85 | 0.037 | about 0.50 |
| 10 | 3 | 2.96 | 28.50 | 0.00 | 0.00 |
| 15 | 3 | 3.65 | 38.21 | 0.00 | 0.00 |
| 20 | 3½ | 2.41 | 26.65 | 0.00 | 0.00 |
| 25 | 3¾ | 3.60 | 27.50 | 0.00 | 0.00 |
| 30 | 3½ | 3.70 | 34.52 | 0.00 | 0.00 |
| 35 | 3⅛ | 3.14 | 31.86 | 0.00 | 0.00 |

It will be observed from the results of the above tests that all specimens were wettable even after thirty-five launderings to the extent that a one inch by six inch specimen wicked at least about 2¾ inches of water in three minutes, a ten inch by two inch specimen saturated in less than four minutes, a ten inch by two inch specimen transferred one hundred cc. of water in less than thirty-five minutes, a one-half inch by one-half inch specimen saturated substantially instantly when dropped in water, and a drop of water dropped onto the fabric lost its specular reflective power substantially instantly.

The percentages stated above for the wettability treatment agent (i.e., 0.16% to 0.065% by weight of the weight of the water, with 0.032% as the preferred percentage) refer to weight of the agent per se. Generally, the agent will be supplied dispersed in water with the agent constituting 35% by weight of the water. Thus, the preferred amount of this dispersion to be put in the water in the laundering machine will be 0.093% of the weight of the water, which is equal to two pounds of the dispersion for the 258 gallons of water (two pounds of the dispersion containing 0.70 lb. of said agent, which is equal to 0.032% of the weight of the 258 gallons).

It will be observed that the same volume of water (258 gallons) with the same percentage of the wettability treatment agent (0.70 lb. or 0.032% of the weight of the 258 gallons of water) was used to treat four lbs. of fabric in Example III as to treat one hundred lbs. of fabric in Examples I and II. This was because the Norwood Cascade laundering machine used in all the examples has a 258 gallon fill. The one hundred lb. load is the maximum load for the machine. As to Examples I and II (full one hundred lb. loads), substantially all the wettability treatment agent was exhausted from the water onto the fabric. As to Example III (a four lb. load), it appears that about 4/100 of the wettability agent, meaning about 0.028 lb. was exhausted onto the fabric to provide the results tabulated in Table III.

In view of the above, it will be seen that the several objects of the invention are achieved and other advantageous results attained.

As various changes could be made in the above methods and products without departing from the scope of the invention, it is intended that all matter contained in the above description shall be interpreted as illustrative and not in a limiting sense.

What is claimed is:

1. The method of treating nylon fabric for wettability, with the treated fabric washable in typical home laundering manner for a substantial number of launderings without undue loss of wettability comprising agitating the fabric in a bath comprising a wettability treatment agent in water, said agent comprising a condensation product of ethylene oxide with an aliphatic primary amine having between about 16 and about 18 carbon atoms in a ratio of about 16 moles ethylene oxide per mole of said primary amine, quaternized with methyl sulfate, the bath being at a temperature of from about 110° F. to 130° F., the agitation being such as to cause relative flow of the bath through the fabric from opposite sides of the fabric, the amount of said agent in the bath and the agitation being such as to cause exhaustion of said agent in amount from at least about 0.35% to about 1.40% by weight of the fabric onto the fabric from the bath with said agent dispersed substantially uniformly throughout the fabric.

2. The method of claim 1 wherein the amount of said agent in the water at the start of the treatment is from about 0.016% to about 0.065% by weight of the weight of the water.

3. The method of claim 2 wherein the amount of said agent in the water at the start of the treatment is about 0.032% by weight of the weight of the water.

4. The method of claim 1 wherein the agitation is effected by tumbling the fabric at the rate of about fifteen tumbles per minute for about twenty minutes.

5. The method of claim 4 wherein the amount of said agent in the water at the start of tumbling is from about 0.016% to about 0.065% by weight of the weight of the water.

6. The method of claim 4 wherein the amount of said agent in the water at the start of tumbling is about 0.032% by weight of the weight of the water.

7. The method of claim 4 wherein the tumbling of the fabric is in opposite directions.

8. The method of claim 7 wherein the fabric is tumbled a number of times in one direction and then a number of times in the opposite direction and this is repeated.

9. The method of treating nylon fabric for wettability, with the treated fabric washable in typical home laundering manner for a substantial number of launderings without undue loss of wettability comprising agitating the fabric in a bath comprising a wettability treatment agent in water, said agent comprising a condensation product of ethylene oxide with an aliphatic primary amine having between about 16 and about 18 carbon atoms in a ratio of about 16 moles ethylene oxide per mole of said primary amine, quaternized with methyl sulfate, the bath being at a temperature of from about 110° F. to 130° F., the agitation being such as to cause relative flow of the bath through the fabric from opposite sides of the fabric, the amount of said agent in the bath being from about 0.35 lb. to about 1.40 lb. per 100 lbs. of fabric and the agitation being such as to cause exhaustion of said agent in said amount per 100 lbs. of fabric onto the fabric from the bath with said agent dispersed substantially uniformly throughout the fabric.

10. The method of claim 9 wherein the amount of said agent in the bath is about 0.70 lb. per 100 lbs. of fabric.

11. The method of claim 9 wherein the agitation is effected by tumbling the fabric at the rate of about fifteen tumbles per minute for about twenty minutes.

12. The method of claim 11 wherein the tumbling of the fabric is in opposite directions.

13. The method of claim 12 wherein the fabric is tumlbed a number of times in one direction and then a number of times in the opposite direction and this is repeated.

14. Nylon fabric treated with a wettability treatment agent comprising a condensation product of ethylene oxide with an aliphatic primary amine having between about 16 and about 18 carbon atoms in a ratio of 16 moles ethylene oxide per mole of said primary amine, quaternized with methyl sulfate in accordance with claim 1, the fabric being wettable to the extent that a one inch by six inch specimen will wick at least about 2¾ inches of water in three minutes, a ten inch by two inch specimen will saturate in less than four minutes, a ten inch by two inch specimen will transfer one hundred cc. of water in less than thirty-five minutes, a one-half inch by one-half inch specimen will saturate substantially instantly when dropped in water, and a drop of water dropped onto the fabric loses its specular reflective power substantially instantly, and said fabric retaining said wettability for at least about thirty-five launderings of the home laundering type.

15. Nylon fabric as set forth in claim 14 wherein said agent is dispersed throughout the fabric in the amount of about 0.70% by weight of the fabric.

* * * * *